United States Patent [19]

Svensson

[11] Patent Number: 4,593,872

[45] Date of Patent: Jun. 10, 1986

[54] ANCHORING DEVICE FOR POSTS FOR FENCES, GUARD-RAILS, TENTS ETC.

[76] Inventor: Sven-Eric A. Svensson, Erik Stenbergsgatan 23, S-260 35 Ödåkra, Sweden

[21] Appl. No.: 709,022

[22] PCT Filed: May 24, 1984

[86] PCT No.: PCT/SE84/00198

§ 371 Date: Jan. 25, 1985

§ 102(e) Date: Jan. 25, 1985

[87] PCT Pub. No.: WO84/04774

PCT Pub. Date: Dec. 6, 1984

[30] Foreign Application Priority Data

May 25, 1983 [SE] Sweden ..... 8302938

[51] Int. Cl.[4] ..... E04H 17/22

[52] U.S. Cl. ..... 248/156; 248/530; 52/157

[58] Field of Search ..... 248/156, 530, 532; 265/65, 58; 52/165, 155, 157

[56] References Cited

U.S. PATENT DOCUMENTS

| | | | |
|---|---|---|---|
| Re. 26,779 | 2/1970 | Weichenrieder | 248/156 |
| 200,217 | 2/1878 | Mudgett | 248/156 |
| 1,736,177 | 11/1929 | Snook | 248/530 |
| 2,347,443 | 4/1944 | Vesely | 248/156 |
| 2,441,109 | 5/1948 | Carlson | 248/156 |
| 2,525,890 | 10/1950 | Gage | 248/156 |
| 2,577,333 | 12/1951 | Klum | 248/156 |
| 2,823,785 | 7/1974 | Toliver | 248/156 |
| 3,286,962 | 11/1966 | Warth | 248/156 |
| 3,318,560 | 5/1967 | Garrette | 248/532 |

FOREIGN PATENT DOCUMENTS

| | | | |
|---|---|---|---|
| 106239 | 11/1898 | Fed. Rep. of Germany | 248/156 |
| 1427152 | 3/1976 | United Kingdom | 248/156 |

*Primary Examiner*—Reinaldo P. Machado
*Assistant Examiner*—Alvin Chin-Shue
*Attorney, Agent, or Firm*—Birch, Stewart Kolasch & Birch

[57] ABSTRACT

An anchoring device for fence posts, guard-rails, tents, garden greenhouses and the like includes a sleeve which is fluted on its inner side and provided at its bottom with two intersecting arms forming a stop device for the bottom end of the post upon insertion into the sleeve. Furthermore, the sleeve has at its bottom end a cylindrical wall formed with downwardly facing serrations to facilitate rotation of the sleeve into the ground. An anchoring member detachably fixed in the sleeve is bored into the ground for anchoring the anchoring device together with said cylindrical wall.

6 Claims, 6 Drawing Figures

ANCHORING DEVICE FOR POSTS FOR FENCES, GUARD-RAILS, TENTS ETC.

The present invention relates to an anchoring device which is intended for posts of wood or metal for, primarily fences, guard-rails, tents, and garden greenhouses etc., which can be quickly and readily anchored in the ground in such a manner that the post itself will not be in direct contact with the soil, whereby rotting and corrosion of the post are prevented.

As is well known, posts of, for example, wood which are otherwise sound and could have been used for a long time yet, must be replaced long before then because the short part of the post positioned in the top layer of the ground has rotted.

To counteract such rotting, it has been proposed to position the lower end of the post in concrete, but the result is not much better because the concrete then is in intimate contact with the post and thus prevents evaporation of the moisture penetrating into the wooden post. Furthermore, cracks and the like are soon formed at the upper part of the concrete base, through which water can penetrate.

It will also be appreciated that the above-mentioned post anchoring technique is very time-consuming and expensive.

Other methods of anchoring posts for the above-mentioned applications have also been proposed, but have never been used in actual practice because they have been far too complicated and expensive.

The present invention aims at eliminating the shortcomings encountered with prior art techniques and to provide a post anchoring device which is simple in use and inexpensive in manufacture and which to a very high degree precludes rotting of wooden posts and also reduces corrosion in posts of other materials.

This is accomplished in that the upper part of the sleeve in which the post is anchored, is efficiently drained and vented so that no water can remain between the sleeve and the post end inserted therein, and so that any moiture absorbed by the post itself can readily evaporate. In addition, the post is supported entirely above the ground surface and thus is readily replaceable.

According to the invention, the holder furthermore is secured to an anchoring member which is screwed into the ground for rapid anchoring of the device. The anchoring member is exchangeable to make it possible to use anchoring members of different lengths according to the post height and the soil conditions. The device according to the invention can therefore be used for a variety of applications requiring posts of different types. The anchoring device is extremely useful also for tents and garden greenhouses because it can be removed from the ground attachment just as easily as it is mounted.

The invention will be explained in more detail below, reference being had to the embodiments illustrated in the accompanying drawings in which FIG. 1 is a schematic view of a fence with two posts mounted each in one anchoring device;

Figure 1:
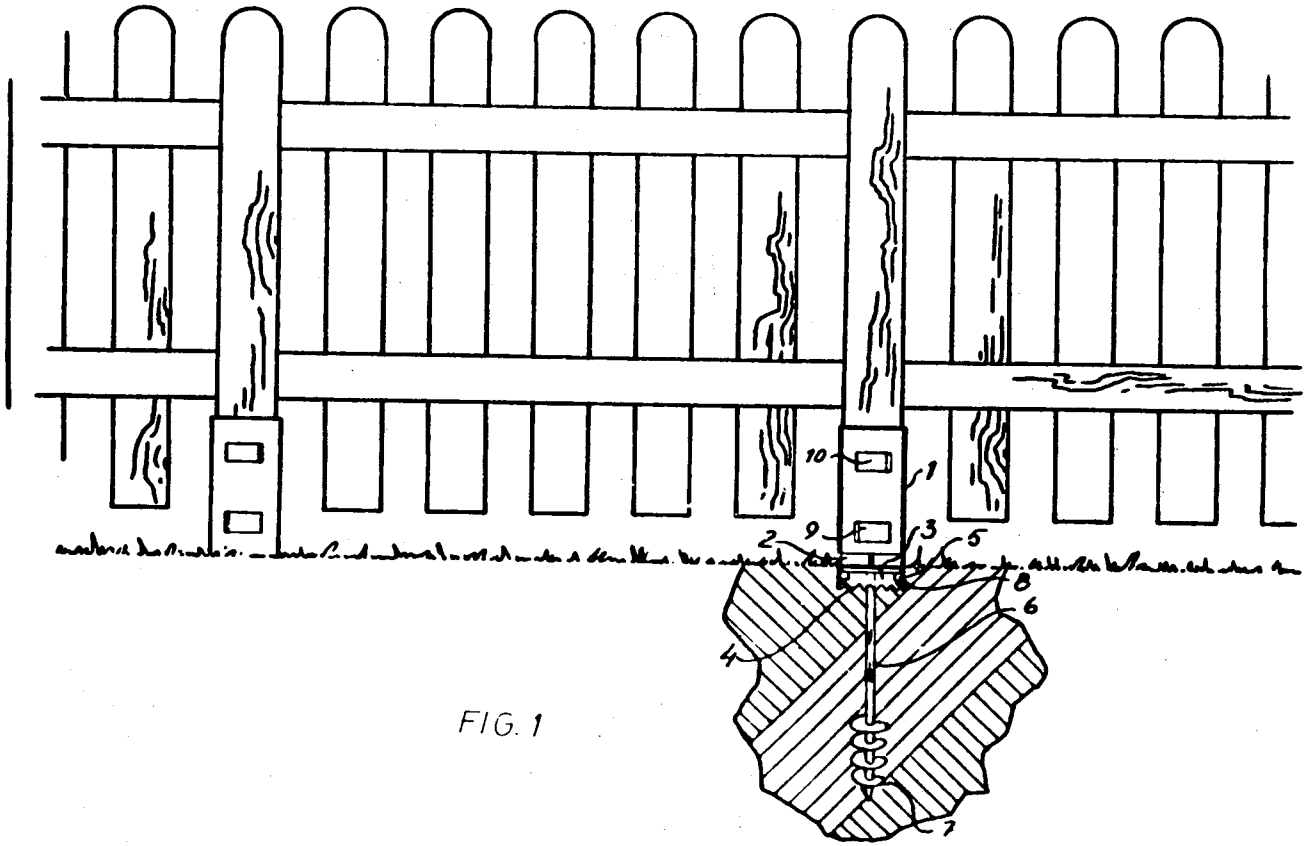
Figure 2:
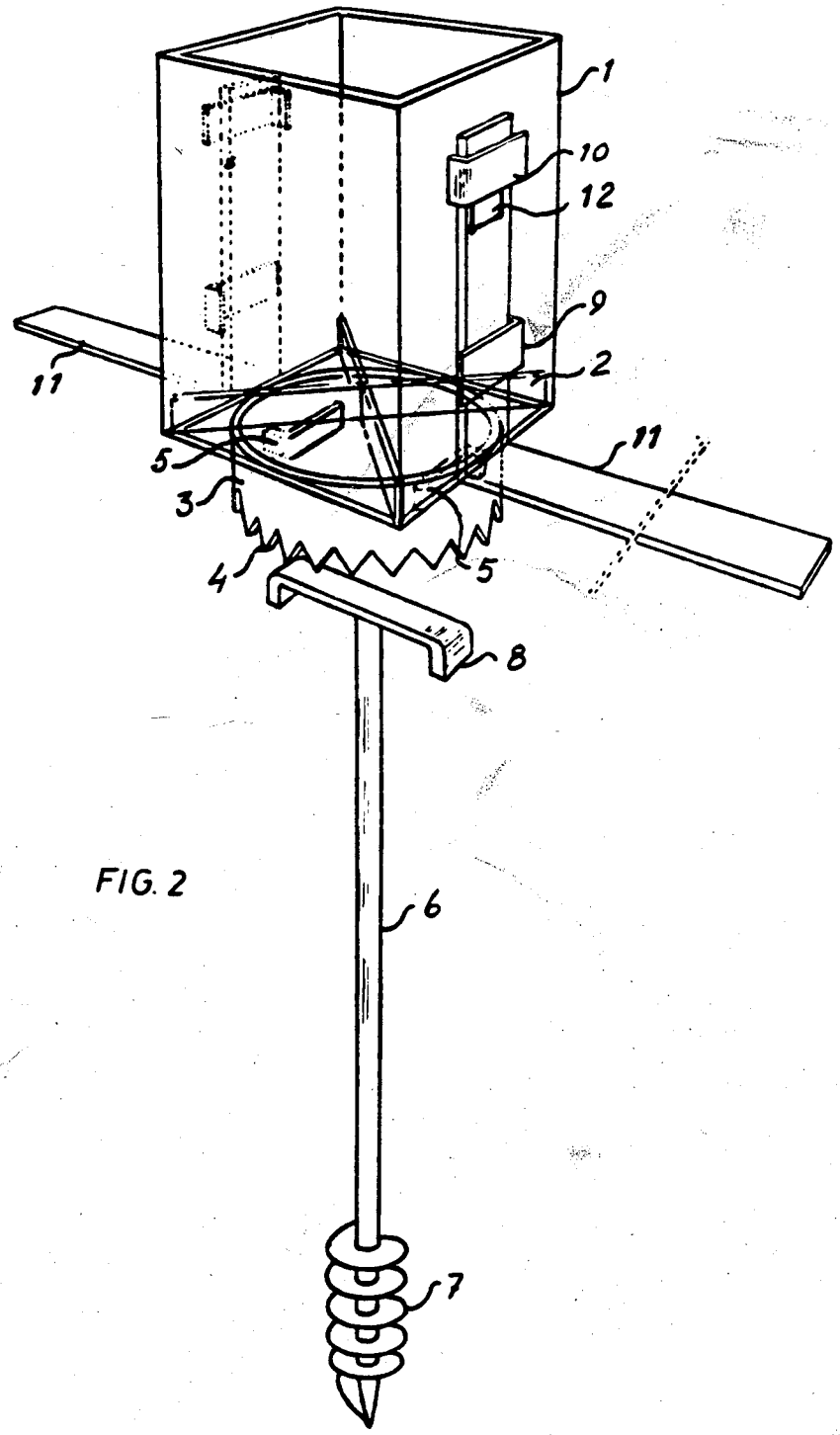
FIG. 2 is a perspective view of the anchoring device.
Figure 3:
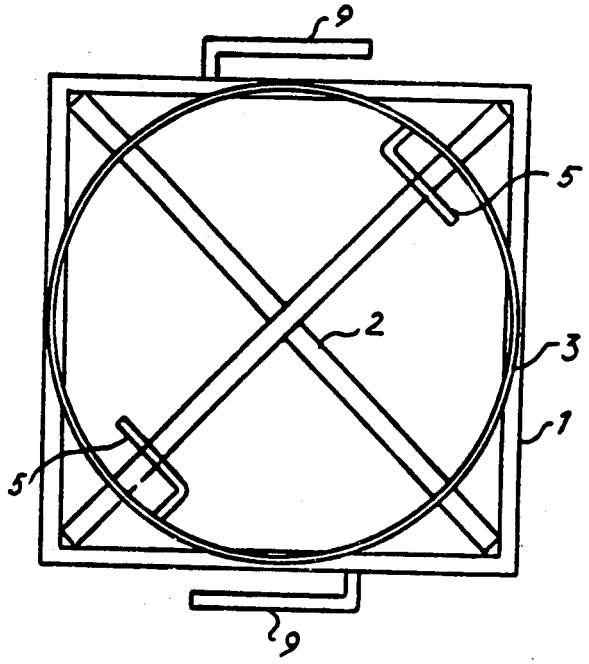
FIG. 3 is a schematic view of the anchoring device for the post, as seen from below.
Figure 4:
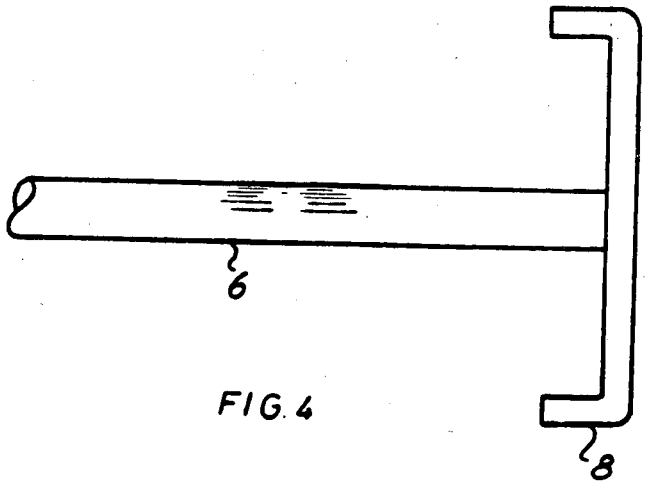
FIG. 4 is a front view of an anchoring member.
Figure 6:
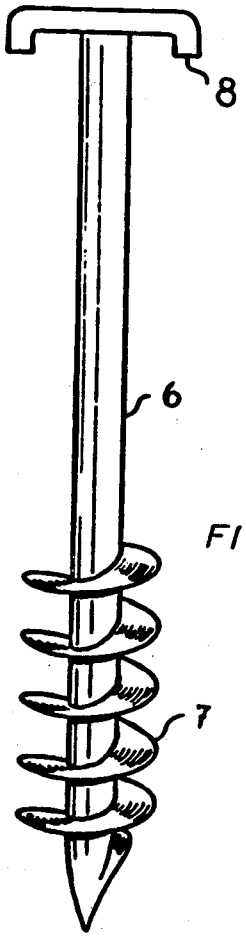
FIG. 6 is a front view of the screw-like anchoring member.
Figure 5:
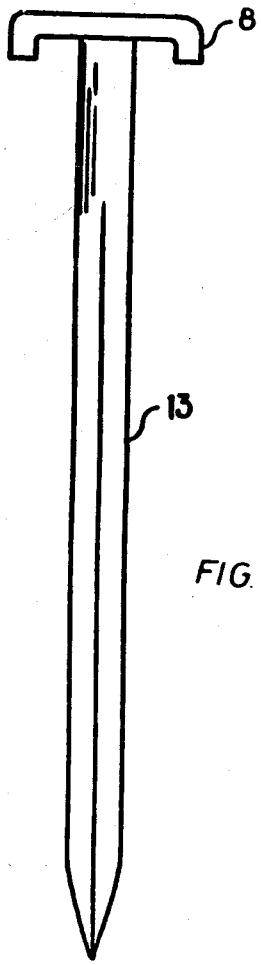
FIG. 5 illustrates an alternative anchoring member for use in stone or similar hard materials.

The post anchoring device according to the present invention comprises a holder or sleeve 1 in which the lower end of a post is inserted. The inner side of the sleeve 1 is fluted to permit air to circulate between the post and the sleeve. The lower opening of the sleeve 1 has two intersecting arms 2 forming end stop means for the post and an opening for air circulation. The arms 2 also serve as a spacer member preventing the post from coming into direct contact with the ground surface. Furthermore, the sleeve 1 carries at its bottom end a fixed cylindrical wall 3 contacting the inner edge of the sleeve and is provided at its lower edge with serrations 4 for penetration into the ground and for stabilizing the device.

Two tongues 5 are fixedly mounted opposite one another on the inner periphery of the cylindrical wall 3 and define opposing openings functioning as a type of bayonette catch for the anchoring members 13 or 6 which are provided, at one end, with a fastening member 8 having bent ends rotatable into locking engagement with the openings of the tongues 5. The anchoring members 13 and 6 are exchangeable for adaptation to different ground conditions. One anchoring member is for use in stone or similar hard material, while the other is for use in normal soil. The anchoring members can also be manufactured in different lengths adapted to the post size.

The anchoring member 6 is provided at its lower end with an anchoring screw 7 which is rotated down into the ground and finally, together with the cylindrical wall 3 and the serrations 4, completes anchoring of the post anchoring device.

If the ground conditions for some reason or other are unfavorable and an additional support of the anchoring device and the post is required, the sleeve may be provided with two holders 9 and 10 mounted opposite one another on the outer side of the sleeve and having opposed openings. These holders 9 and 10 constitute attachments for two stabilizing angle irons 11 which are locked to the sleeve by means of lugs 12 on one or both sides of the sleeve 1.

According to the invention, different types of posts may be mounted practically without the aid of tools and also without any spade work. Furthermore, the risk of rotting or corrosion of the parts has been eliminated, and the post material which otherwise would have been placed in the ground, has been saved.

I claim:

1. An anchoring device for a post, comprising:

an elongated anchoring member having a crosspiece at a top end thereof;

sleeve means for receiving a lower end of the post to be anchored, said sleeve means being fluted on an inner portion thereof;

said sleeve means including two intersecting arms forming a barrier to prevent insertion of the post into said sleeve past said barrier; and cylindrical wall means, fixed to the lower end of said sleeve means, for penetrating the ground and for stabilizing said device, wherein said cylindrical wall means is provided with circumferentially extending serrations and is detachably connected to the crosspiece of said anchoring member;

said anchoring member, said sleeve means, and said cylindrical wall means being adapted to be rotated into the ground.

2. An anchoring device according to claim 1, wherein said sleeve means further includes at least two holders attached to the outer periphery thereof in an opposing relationship, said holders being adapted to accommodate additional means for stablizing said device with respect to the ground.

3. An anchoring device according to claim 1, wherein said elongated anchoring member is exchangeable for adaptation to varying post heights or ground conditions.

4. An anchoring device according to claim 2, wherein said elongated anchoring member is exchangeable for adaptation to varying post heights or ground conditions.

5. An anchoring device according to claim 2, wherein said cylindrical wall means includes two tongues fixedly mounted in an opposing relationship on the inner periphery thereof and define openings such that said crosspiece is rotatable into locking engagement therewith, said crosspiece having downwarldy bent ends engageable with said openings.

6. An anchoring device according to claim 2, wherein said additional means for stabilizing are stabilizing angle irons which are insertable into said at least two holders and locked to said sleeve means by lugs.

* * * * *